US007625071B2

(12) United States Patent
Enomoto et al.

(10) Patent No.: US 7,625,071 B2
(45) Date of Patent: Dec. 1, 2009

(54) LIQUID EJECTION HEAD, IMAGE FORMING APPARATUS AND METHOD OF MANUFACTURING LIQUID EJECTION HEAD

(75) Inventors: Katsumi Enomoto, Kanagawa (JP); Yasuhiko Maeda, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 414 days.

(21) Appl. No.: 11/386,674

(22) Filed: Mar. 23, 2006

(65) Prior Publication Data

US 2006/0244787 A1 Nov. 2, 2006

(30) Foreign Application Priority Data

Mar. 24, 2005 (JP) ..... 2005-086950

(51) Int. Cl.
*B41J 2/05* (2006.01)
*B41J 2/045* (2006.01)
*B41J 2/16* (2006.01)

(52) U.S. Cl. ..... 347/58; 347/70; 347/50

(58) Field of Classification Search ..... 347/50, 347/54, 68–72, 58
See application file for complete search history.

(56) References Cited

U.S. PATENT DOCUMENTS 5,360,943 A * 11/1994 Mori et al. ..... 174/84 R
6,491,384 B2 * 12/2002 Usui et al. ..... 347/70
6,531,223 B1 * 3/2003 Rota et al. ..... 428/402
2005/0231551 A1 * 10/2005 Gibson et al. ..... 347/45

FOREIGN PATENT DOCUMENTS

JP 9-277521 A 10/1997
JP 2003-211677 A 7/2003

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

A liquid ejection head having a flow channel plate in which liquid flow channels are formed and an actuator forming plate on which actuators for generating pressure which ejecting the liquid are formed. Plate bonding parts through which the flow channel plate and the actuator forming plate are bonded together, and electrical bonding parts through which electrical signals are supplied to the actuators, are bonded by non-conductive pastes having same curing conditions.

11 Claims, 9 Drawing Sheets

LIQUID EJECTION HEAD, IMAGE FORMING APPARATUS AND METHOD OF MANUFACTURING LIQUID EJECTION HEAD

BACKGROUND OF THE INVENTION

1. Field of the Invention

The present invention relates to a liquid ejection head, an image forming apparatus and a method of manufacturing a liquid ejection head, and more particularly, to a liquid ejection head has a laminated structure constructed from a plurality of plates bonded together, an image forming apparatus comprising the liquid ejection head, and a method of manufacturing the liquid ejection head.

2. Description of the Related Art

An image forming apparatus is known which forms images on a recording medium, such as paper, by ejecting ink from nozzles toward the recording medium, while moving a liquid ejection head having an arrangement of a plurality of nozzles and the recording medium, relatively with respect to each other.

A known liquid ejection head mounted in an image forming apparatus of this kind is, for example, a piezo type liquid ejection head, in which ink is supplied to pressure chambers connected to nozzles, and the volume of the pressure chambers is changed, thereby causing the ink inside the pressure chambers to be ejected from the nozzles, by applying a drive signal corresponding to the image data to piezoelectric elements which are installed through a diaphragm plate on the outer side of the pressure chambers.

On the other hand, there are also known thermal jet liquid ejection heads which generate a bubble by heating the ink by means of a heater, or other heating element, and eject an ink droplet by means of the pressure thus generated.

Methods for manufacturing a liquid ejection head are known in which a liquid ejection head is constructed by bonding a plurality of plates together. Furthermore, when manufacturing a liquid ejection head, it is necessary to provide electrodes and electrical wires for supplying electrical signals to the actuators which form pressure generating devices, such as piezoelectric elements.

Japanese Patent Application Publication No. 9-277521 (and in particular, FIG. 1) discloses a case where a flow channel substrate formed with ink flow channels and a diaphragm formed with piezoelectric elements are bonded together by a sheet adhesive, whereupon the diaphragm and piezoelectric elements are bonded together by solder.

Japanese Patent Application Publication No. 2003-211677 (and in particular, FIG. 2) discloses a case where a base plate formed with ink channel grooves is bonded by adhesive to a heater board formed with heaters, and the heater board is then bonded to a heater drive IC by using an anisotropic conductive film (ACF), or the like.

However, if the bonding between the lamination plates and the electrical bonding for supplying electrical signals to the actuators are carried out by separate steps, then the processing is time-consuming and it is difficult to restrict manufacturing costs.

Furthermore, there are demands for improved image quality, and in order to respond to these demands, it has been necessary to arrange nozzles in a two-dimensional array, as well as increasing the nozzle density. In order to achieve both two-dimensional arrangement and high-density arrangement of the nozzles in this way, there have been the issues of how to dispose the electrical wiring, and how to actually carry out the bonding between the lamination plates, and the electrical bonding for supplying an electrical signal to the actuators.

SUMMARY OF THE INVENTION

The present invention has been contrived in view of the foregoing circumstances, an object thereof being to provide a liquid ejection head, an image forming apparatus using this liquid ejection head, and a method of manufacturing a liquid ejection head, whereby the manufacturing process can be simplified when constructing a liquid ejection head by bonding a plurality of plates together.

In order to attain the aforementioned object, the present invention is directed to a liquid ejection head, comprising: a flow channel plate in which liquid flow channels are formed; and an actuator forming plate on which actuators for generating pressure when ejecting the liquid are formed, wherein plate bonding parts through which the flow channel plate and the actuator forming plate are bonded together, and electrical bonding parts through which electrical signals are supplied to the actuators, are bonded by means of non-conductive pastes having same curing conditions.

The main component of the non-conductive pastes (NCP) is high-purity non-conductive resin. The NCP is deposited on the bonding parts in the form of a paste (or liquid), and it is cured while applying compression under prescribed curing conditions. A specific embodiment of NCP is one having a high-purity epoxy resin as the main component.

The mode of depositing the NCP is not limited in particular to a mode where the NCP of the same type is deposited on all of the bonding sections between the plates and the electrical bonding sections, but the NCP which at least cures at the same temperature, in the curing conditions, is used in all of the bonding parts between the plates and the electrical bonding parts.

When the liquid ejection head is actually in use, the NCP has already left its paste (or liquid) state and is in a cured state.

According to the present invention, since the plate bonding between the plates and the electrical bonding for supplying electrical signals to the actuators are carried out simultaneously under the same curing conditions, the manufacturing process is simplified and manufacturing costs can be restricted, in comparison with the liquid ejection head in the related art in which it is necessary to perform the steps of bonding the plates, and creating electrical bonds for supplying electrical signals to the actuators, in separate processes.

Furthermore, since the NCP has extremely low content of sodium ions, the generation of insoluble material which precipitates into the liquid is suppressed, thus preventing the occurrence of ejection failures in the nozzles. Furthermore, since the NCP has extremely low content of chloride ions, corrosion is not liable to occur even if metal plates are used, and therefore, deterioration in ejection performance is prevented.

Preferably, the non-conductive pastes include inorganic filler particles of a size not more than 5 μm.

According to the present invention, it is possible to ensure the strength of the laminated structure, while preserving the adhesive function of the NCP.

In order to attain the aforementioned object, the present invention is also directed to a liquid ejection head, comprising: a pressure chamber forming plate in which pressure chambers connected to liquid ejection ports are formed; an actuator forming plate on which actuators for generating pressure when ejecting the liquid are formed; and a common liquid chamber forming plate which is arranged on a side of the actuator forming plate reverse to a side thereof adjacent to the pressure chamber forming plate, a common liquid chamber and electrical wires being formed in the common liquid chamber forming plate, the common liquid chamber supplying the liquid to the pressure chambers, the electrical wires passing through at least a portion of the common liquid chamber and rising up substantially perpendicularly with respect to a surface on which the actuators are arranged, wherein plate bonding parts through which the actuator forming plates and the common liquid chamber forming plate are bonded together, and electrical bonding parts through which the actuators and the electrical wires are electrically bonded together, are bonded by means of non-conductive pastes having same curing conditions.

It is also possible for a plate (intermediate plate) for protecting the actuators to be interposed between the actuator forming plate and the common liquid chamber forming plate. In this case, the plate bonding parts between the actuator forming plate and the intermediate plate, and the plate bonding parts between the intermediate plate and the common liquid chamber forming plate are bonded by means of the NCP having the same curing conditions, together with the electrical bonding parts.

On the other hand, if no intermediate plate is interposed between the actuator forming plate and the common liquid chamber forming plate and these plates are bonded together directly, then the direct bonding parts between the actuator forming plate and the common liquid chamber forming plate is bonded with the NCP having the same curing conditions, together with the electrical bonding parts.

According to the present invention, since the electrical wires are provided so at to rise up in the substantially perpendicular direction with respect to the actuator installation surface and to pass at least partially through the common liquid chamber, then it becomes unnecessary to lay the electrical wires horizontally on the actuator installation surface, thus enabling two-dimensional arrangement and high-density arrangement of the nozzles. Furthermore, since the plate bonding and the electrical bonding between the electrical wires and the actuators can be carried out simultaneously under the same curing conditions, then the manufacturing process is simplified and manufacturing costs can be restricted.

Preferably, the liquid ejection head further comprises a flexible printed circuit which is connected to the electrical wires, wherein electrical bonding parts through which the flexible printed circuit and the electrical wires are electrically bonded together are bonded by means of the non-conductive pastes having the same curing conditions.

In order to attain the aforementioned object, the present invention is also directed to an image forming apparatus, comprising the above-described liquid ejection head, which forms an image on a recording medium by means of the liquid ejected from the liquid ejection head onto the recording medium.

In order to attain the aforementioned object, the present invention is also directed to a method of manufacturing a liquid ejection head constructed by bonding a plurality of plates together, the method comprising the steps of: preparing the plurality of plates including: a flow channel plate in which liquid flow channels are formed; and an actuator forming plate on which actuators for generating pressure when ejecting the liquid are formed; depositing non-conductive pastes having same curing conditions on at least plate bonding parts through which the flow channel plate and the actuator forming plate are bonded together, and electrical bonding parts through which electrical signals are supplied to the actuators; and simultaneously carrying out bonding under the curing conditions at the plate bonding parts and at the electrical bonding parts.

In order to attain the aforementioned object, the present invention is also directed to a method of manufacturing a liquid ejection head constructed by bonding a plurality of plates together, the method comprising the steps of: preparing the plurality of plates including: a pressure chamber forming plate in which pressure chambers connected to liquid ejection ports are formed; an actuator forming plate on which actuators for generating pressure when ejecting the liquid are formed; and a common liquid chamber forming plate which is arranged on a side of the actuator forming plate reverse to a side thereof adjacent to the pressure chamber forming plate, a common liquid chamber and electrical wires being formed in the common liquid chamber forming plate, the common liquid chamber supplying the liquid to the pressure chambers, the electrical wires passing through at least a portion of the common liquid chamber and rising up substantially perpendicularly with respect to a surface on which the actuators are arranged; depositing non-conductive pastes having same curing conditions on at least plate bonding parts through which the actuator forming plates and the common liquid chamber forming plate are bonded together, and electrical bonding parts through which the actuators and the electrical wires are electrically bonded together; and simultaneously carrying out bonding under the curing conditions at the plate bonding parts and at the electrical bonding parts.

The deposition of the NCP onto the bonding sections may involve a mode which applies the NCP in the form of a paste (or liquid) directly onto the bonding sections, from a tool, a mode which deposits the NCP previously onto a sheet and then transfers the NCP from the sheet, or a mode based on screen printing using a mask, or the like. By using the NCP in this way, the range of choice of the applying method is increased, and the freedom in selecting a method which takes account of the circumstances of the applied surface and the cost benefits is improved.

Furthermore, provided that the curing conditions are the same, it is also possible to deposit the NCP in different modes, in the bonding sections between plates and the electrical bonding sections.

According to the present invention, the manufacturing process is simplified and manufacturing costs are reduced in comparison with the related art in which the bonding between plates and the electrical bonding must be carried out respectively in separate steps.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
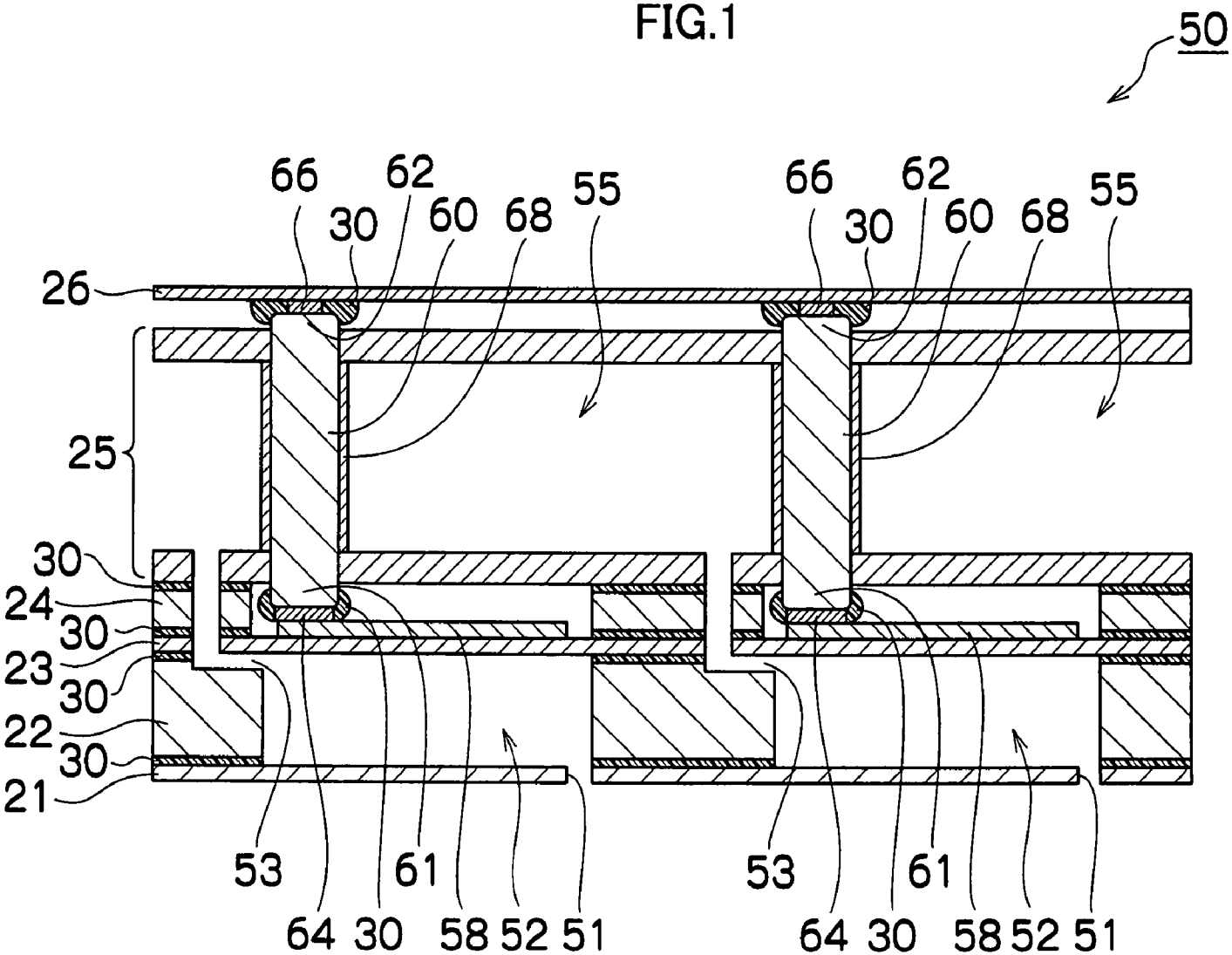
FIG. 1 is a cross-sectional diagram of a liquid ejection head according to one embodiment of the present invention.

FIG. 1 is a cross-sectional diagram showing a liquid ejection head 50 according to an embodiment of the present invention.

In FIG. 1, the liquid ejection head 50 has a laminated structure constructed from a plurality of plates 21, 22, 23, 24 and 25 bonded together.

The nozzle forming plate 21 (also called "nozzle plate") is formed with a plurality of nozzles 51 (ejection ports) which eject liquid.

The pressure chamber forming plate 22 is formed with a plurality of pressure chambers 52 which connect respectively to the nozzles 51. The pressure chambers 52 may also be called "individual flow channels".

The diaphragm 23 (also called "actuator forming plate") is disposed on the side of the pressure chamber forming plate 22 reverse to the side adjacent to the nozzle forming plate 21. A plurality of piezoelectric elements 58 forming pressure generating devices, which generate pressure imparted to the ink inside the pressure chambers 52, are formed on the diaphragm 23.

The piezoelectric elements 58 are made of lead zirconate titanate (PZT), for example. The piezoelectric element 58 generates a displacement (distortion), when applied with a prescribed electrical signal (drive signal), thereby changing the volume of the pressure chamber 52 through the diaphragm 23.

The diaphragm 23 constitutes the surfaces (vibrating surfaces) of the respective pressure chambers 52 opposite to the sides where the nozzles 51 are situated, and the diaphragm 23 also functions as one electrode of each of the piezoelectric elements 58.

The diaphragm 23 according to the present embodiment is formed by one plate that is common for the plurality of pressure chambers 52, but it is not limited to a case of this kind, and may also be formed separately for each pressure chamber 52.

The piezoelectric element protection plate 24 (also called a "piezo cover" or "intermediate plate") protects the piezoelectric elements 58 by ensuring a space in such a manner that each piezoelectric element 58 can generate a displacement freely in the thickness direction (in other words, in such a manner that the operation of the piezoelectric elements 58 is unobstructed).

The common liquid chamber forming plate 25 is disposed on the side of the diaphragm 23 and the piezoelectric element protection plate 24 reverse to the side where the pressure chamber forming plate 22 is located. The common liquid chamber forming plate 25 is formed with a common liquid chamber 55, which supplies the ink to the pressure chamber 52, and a plurality of column-shaped electrical wires 60.

The common liquid chamber 55 supplies the ink to the plurality of pressure chambers 52 through ink supply ports 53. The common liquid chamber 55 may also be called a common flow channel.

More specifically, when the pressure chambers 52 are observed with the nozzles 51 facing downward, the common liquid chamber 55 is formed as a liquid chamber constituting a single common space, directly above the plurality of pressure chambers 52, in such a manner that the common liquid chamber 55 covers all of the plurality of pressure chambers 52. By means of the common liquid chamber 55 of this kind, the ink is supplied to the respective pressure chambers 52 with good refill efficiency.

In FIG. 1, the shape of the flow channels from the common liquid chamber 55 to the pressure chambers 52 is depicted as being an "L" shape, in order to simplify the drawing, but the flow channels are not limited to being a shape of this kind. Desirably, in order to prioritize refilling characteristics of the ink from the common liquid chamber 55 into the pressure chambers 52, the flow channels are formed perpendicularly from the common liquid chamber 55 to the pressure chambers 52 (in an "I" shape).

The column-shaped electrical wires 60 are made of a conductive material, and rise up in a substantially vertical direction from the surface on which the piezoelectric elements 58 are installed (in other words, the electrical wires 60 rise up substantially perpendicularly with respect to the diaphragm 23). The column-shaped electrical wires 60 are column-shaped wires which extend from bump electrodes 64 on the piezoelectric elements 58 and passing through the common liquid chamber 55 until reaching bump electrodes 66 on a flexible wiring plate 26 (flexible printed circuit: FPC). By means of these column-shaped electrical wires 60, drive signals are applied to the respective piezoelectric elements 58 while achieving highly efficient use of the surface area. In other words, a higher density of the pressure chambers 52 can be achieved and the density of the nozzles 51 can be increased accordingly, in comparison with a case where drive wires are laid in parallel on the surface on which the piezoelectric element 58 are arranged.

The shape of the column-shaped electrical wires 60 is not limited in particular to a circular cylinder shape or a right prism shape. For example, the column-shaped electrical wires 60 may also have a tapered shape in which the cross-sectional surface area gradually increases (or declines).

A protective film 68 having insulating properties (an insulating and protective film) is formed on the outer circumferential surfaces of the column-shaped electrical wires 60 (the surfaces which make contact with the ink inside the common liquid chamber 55).

The flexible wiring plate 26 has a plurality of electrical wires, and drive signals are supplied to the respective piezoelectric elements 58 through the flexible wiring plate 26 and the column-shaped electrical wires 60 in the common liquid chamber forming plate 25.

The electrical wires formed on the flexible wiring plate 26 are bonded to the column-shaped electrical wires 60 through the bump electrodes 66 formed on the flexible wiring plate 26. In other words, the bump electrodes 66 on the flexible wiring plate 26 are connected electrically to the column-shaped electrical wires 60. More specifically, the bump electrodes 66 on the flexible wiring plate 26 and end portions 62 on the outer side of the column-shaped electrical wires 60 (the upper side in FIG. 1) are fixed and bonded together by means of a non-conductive paste (NCP) 30.

Furthermore, the column-shaped electrical wires 60 are bonded to the piezoelectric elements 58 by means of the bump electrodes 64 formed on the piezoelectric elements 58. In other words, the column-shaped electrical wires 60 are bonded electrically to the bump electrodes 64 on the piezoelectric elements 58. More specifically, the bump electrodes 64 on the piezoelectric elements 58 and end portions 61 of the inner side of the column-shaped electrical wires 60 (the lower side in FIG. 1) are fixed and bonded together by means of the NCP 30.

The common liquid chamber forming plate 25 and the piezoelectric element protection plate 24 are bonded together by the NCP 30. Similarly, the piezoelectric element protection plate 24 and the diaphragm 23 are also bonded together by the NCP 30. In the same way, the diaphragm 23 and the pressure chamber forming plate 22 are bonded together by the NCP 30. Furthermore, the pressure chamber forming plate 22 and the nozzle forming plate 21 are also bonded together by the NCP 30. In other words, all of the bonds between the respective plates are made by using the NCP 30.

The NCP 30 is made of a non-conductive resin of high purity, preferably a non-conductive resin of 95 wt % or above, more preferably a non-conductive resin of 98 wt % or above. The NCP 30 is deposited on the bonding sections in the form of a paste (or liquid state), and when the respective bonding sections are heated while being pressed together, the NCP 30 contracts and hardens at a prescribed temperature. Thereby, the respective bonding sections become fixed and sealed in a state where they are securely bonded together.

The NCP 30 used may be NCP made of a high-purity epoxy resin, for example, preferably epoxy resin of 95 wt % or above, more preferably epoxy resin of 98 wt % or above.

The NCP 30 has an extremely low content of sodium ions ($Na^+$) (for example, less than 5 ppm). Accordingly, the generation of insoluble material which precipitates into the ink is suppressed.

Furthermore, the NCP 30 has an extremely low content of chloride ions ($Cl^-$) (for example, less than 15 ppm). Consequently, even if metal plates are used, corrosion is not liable to occur.

When the manufacturing of the liquid ejection head 50 has been completed and the head is being used, needless to say, the NCP 30 has left its paste state (or liquid state) and is in a cured state.

Figure 2:
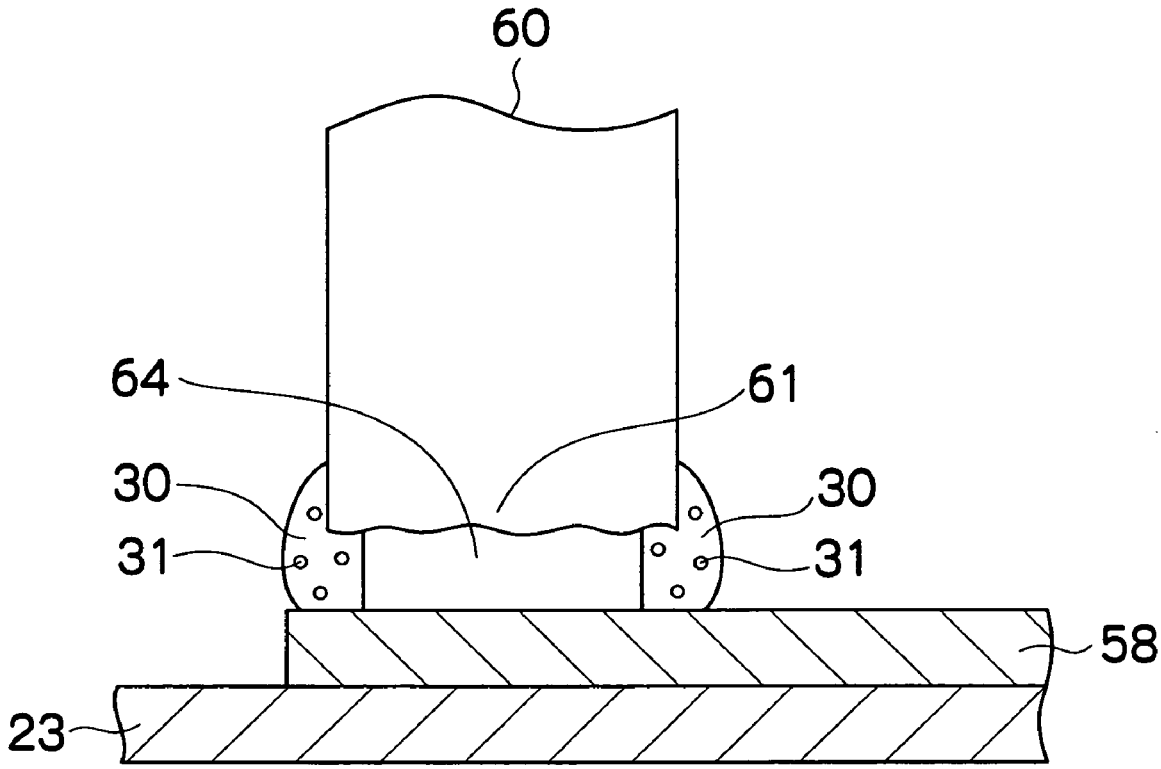
FIG. 2 is an enlarged diagram showing an enlarged view of a bonding section between a column-shaped electrical wire and a piezoelectric element.

FIG. 2 is an enlarged diagram showing an enlarged view of the electrical connection section between the column-shaped electrical wire 60 and the bump electrode 64 on the piezoelectric element 58.

In FIG. 2, in order to simplify the description, the unevenness on the lower end section 61 of the column-shaped electrical wire 60 is depicted in a slightly exaggerated fashion. Desirably, the shape of the bump electrode 64 is actually a column shape having a flat surface on the upper part which is bonded to the column-shaped electrical wire 60, as shown in FIG. 1. Thereby, the contact surface area between the bump electrode 64 and the column-shaped electrical wire 60 is increased, and the reliability of the electrical connection is improved. When the column-shaped electrical wire 60 is pressed against the bump electrode 64 of this kind, the bump electrode 64 itself deforms. Gold (Au), for example, is used as the material of the bump electrode 64. The NCP 30 is deposited on the bonding section, in the form of a paste (or liquid state), and when the column-shaped electrical wire 60 and coupling member 64 are heated in the pressurized state, the NCP 30 contracts and hardens. Due to the deformation of the bump electrode 64 and the contraction of the NCP 30 in this way, a securely bonded state is formed between the column-shaped electrical wire 60 and the bump electrode 64. The column-shaped electrical wire 60 and the bump electrode 64 are sealed and fixed together and the bond between same is guaranteed. In other words, the NCP 30 has a function of bonding the electrical bonding section and a function of sealing off the electrical bonding section.

Desirably, the total of the height of the bump electrode 64 and the height of the electrode of the column-shaped electrical wire 60 (the lower end portion of the column-shaped electrical wire 60 projecting beyond the lower surface of the common liquid chamber forming plate 25 in FIG. 1) is 10 μm to 100 μm. Thereby, it is possible to ensure absorption of height variations caused by deformation of the bump electrodes 64 and 66, while preventing electrical problems, such as shorting due to excessive deformation of the bump electrodes 64 and 66.

FIG. 2 only shows the bump electrode 64 on the piezoelectric element 58, but desirably, the bump electrodes 66 on the flexible wiring plate 26 shown in FIG. 1 also have a column shape having a flat surface on the lower part which is bonded to the column-shaped electrical wire 60. Furthermore, the total of the height of the bump electrode 66 and the height of the electrode of the column-shaped electrical wire 60 (the upper end portion of the column-shaped electrical wire 60 projecting beyond the upper surface of the common liquid chamber forming plate 25 in FIG. 1) is 10 μm to 100 μm.

In the embodiment shown in FIG. 2, a plurality of very small inorganic filler particles 31 are contained in the NCP 30.

The basic function of the inorganic filler particles 31 is to adjust the viscosity and to adjust the coefficient of thermal expansion. In the present embodiment, the size (diameter) of the inorganic filler particles 31 is 5 μm or less. Consequently, decline in the rigidity of the bonding section is prevented, while preserving the bonding function of the NCP 30, and hence the strength of the laminated structure is ensured.

Sequence of Manufacturing Process

An embodiment of the manufacturing process of the liquid ejection head 50 shown in FIG. 1 is described in detail here with reference to the drawings.

Firstly, the process of forming the flexible wiring plate 26, the common liquid chamber forming plate 25, the piezoelectric element protection plate 24, the diaphragm 23 formed with the piezoelectric elements 58, the pressure chamber forming plate 22, and the nozzle forming plate 21 (namely, the plate forming process), is described with reference to FIGS. 3A to 3F.

Figure 3A:
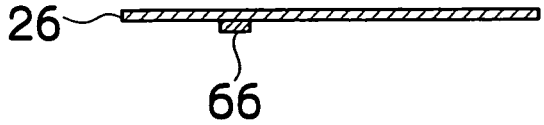
FIGS. 3A to 3F are illustrative diagrams for describing a process for forming respective plates, in a process for manufacturing a liquid ejection head.

The flexible wiring plate 26 is prepared and the bump electrodes 66 made of a material such as gold are formed on the flexible wiring plate 26 as shown in FIG. 3A. These bump electrodes 66 are electrodes which are to be bonded subsequently to the column-shaped electrical wires 60 of the common liquid chamber forming plate 25.

Figure 3B:
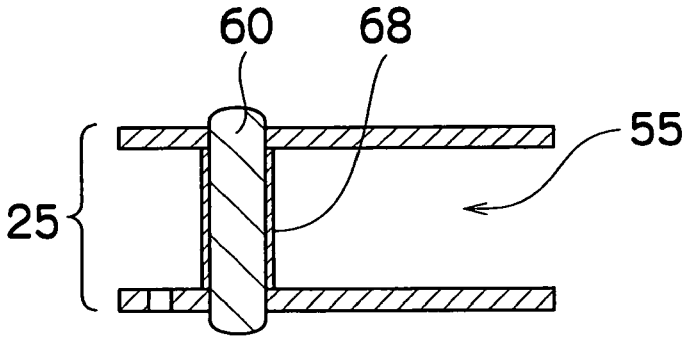

The common liquid chamber forming plate 25 having the common liquid chamber 55 and the column-shaped electrical wires 60 is formed as shown in FIG. 3B. There is no particular restriction on the method of constructing the common liquid chamber forming plate 25, and, for example, it may be constructed by a method in which thin films are bonded together while forming the necessary opening sections by photolithography. It may also be constructed by bonding a plurality of stainless steel plates together. A space for forming the common liquid chamber 55 may also be formed by carrying out etching on a single plate.

The insulating and protective film 68 is formed on the side faces of the column-shaped electrical wires 60 by coating. This is in order to protect the conductive column-shaped electrical wires 60 from the ink inside the common liquid chamber 55.

Figure 3C:
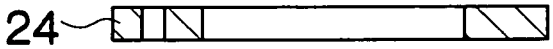

The piezoelectric element protection plate 24 is formed as shown in FIG. 3C. The piezoelectric element protection plate 24 may be formed, for example, by arranging thin films while forming opening sections which are to form the space for protecting the piezoelectric elements 58, by photolithography. The piezoelectric element protection plate 24 may also be constructed by bonding a plurality of stainless steel plates together. The space for protecting the piezoelectric elements 58 may also be formed by carrying out etching on a single plate.

Figure 3D:
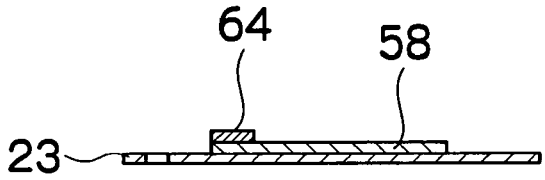

The piezoelectric elements 58 are formed on the diaphragm 23 as shown in FIG. 3D. For example, thin film-shaped piezoelectric elements 58 are formed on the diaphragm 23 by means of aerosol deposition (AD) or sputtering. The bump electrodes 64 made of gold, or the like, are formed on the piezoelectric elements 58. These bump electrodes 64 are electrodes which are to be bonded subsequently to the column-shaped electrical wires 60 of the common liquid chamber forming plate 25.

Figure 3E:
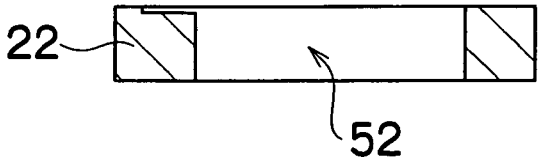

The pressure chamber forming plate 22 having the pressure chambers 52 is formed as shown in FIG. 3E. There is no particular restriction on the method of forming the pressure chamber forming plate 22 and, for example, the pressure chamber forming plate 22 may be formed by a method in which thin films are bonded together while forming the necessary opening sections by photolithography. The pressure chamber forming plate 22 may also be constructed by bonding a plurality of stainless steel plates together. The spaces for forming the pressure chambers 52 may also be formed by carrying out etching on a single plate.

Figure 3F:
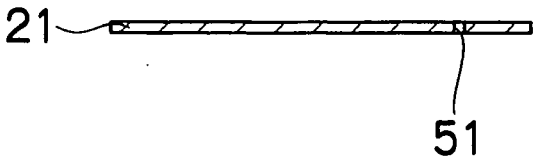

The nozzle forming plate 21 is formed as shown in FIG. 3F. There is no particular restriction on the method of forming the nozzle forming plate 21, and the nozzles 51 are formed in a plate made of polyimide, for example.

Next, the processing for depositing the NCP on the bonding sections between plates and the electrical bonding sections (the NCP deposition processing) is described with reference to FIGS. 4A to 4D.

Figure 4A:
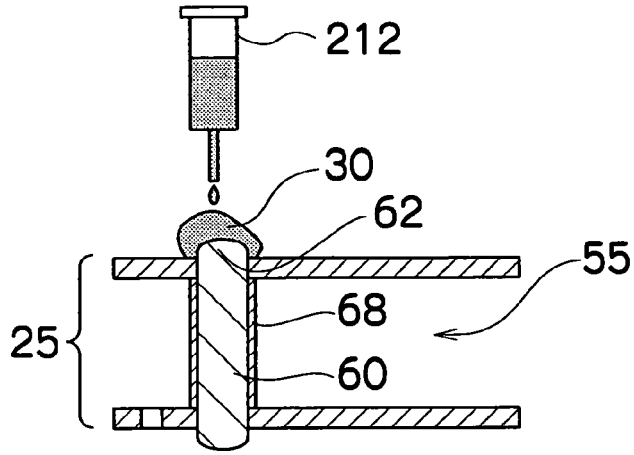
FIGS. 4A to 4D are illustrative diagrams for describing a process of depositing NCP, in a process for manufacturing a liquid ejection head.

As shown in FIG. 4A, the NCP 30 is dispensed onto the end section 62 on the outer side of each column-shaped electrical wire 60 formed in the common liquid chamber forming plate 25. More specifically, the NCP 30 in the form of a paste (or liquid) is applied from a dispenser 212, to the end sections 62 on the outer side of the column-shaped electrical wires 60 (the electrodes which are subsequently to be bonded to the bump electrodes 66 on the flexible wiring plate 26). The NCP 30 is applied in such a manner that it covers the whole of the projecting portion of the end section 62 on the outer side of each of the column-shaped electrical wires 60.

Figure 4B:
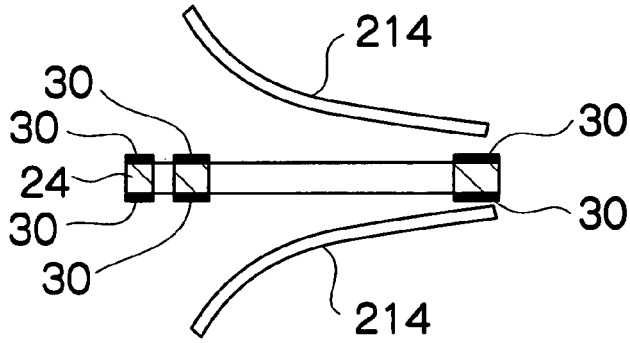

Furthermore, as shown in FIG. 4B, the NCP 30 is transferred onto both of the bonding surfaces of the piezoelectric element protection plate 24 (the surface to be bonded with the common liquid chamber forming plate 25 and the surface to be bonded with the diaphragm 23). More specifically, the NCP 30 on sheets 214 coated with the NCP is transferred onto both bonding surfaces by pressing the sheets 214 against the bonding surfaces of the piezoelectric element protection plate 24 and then peeling away the sheets 214.

Figure 4C:
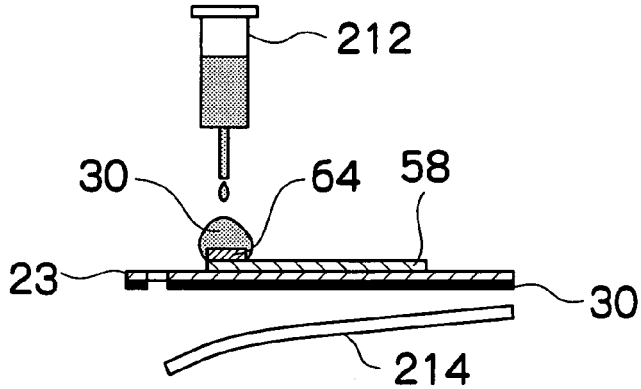

Furthermore, as shown in FIG. 4C, the NCP is dispensed onto the bump electrodes 64 of the piezoelectric elements 58 on the diaphragm 23, and the NCP 30 is also transferred onto the surface of the diaphragm 23 that is to be bonded with the pressure chamber forming plate 22. More specifically, the NCP 30 in the form of a paste (or liquid) is applied from the dispenser 212, to the bump electrodes 64 on the diaphragm 23 (the electrodes which are subsequently to be bonded to the column-shaped electrical wires 60 of the common liquid chamber forming plate 25). The NCP 30 is applied in such a manner that it covers the whole of the projecting portion of each of the bump electrodes 64 on the diaphragm 23.

Furthermore, the NCP 30 on the sheet 214 coated with the NCP is transferred onto the bonding surface of the diaphragm 23 that is to be bonded with the pressure chamber forming plate 22, by pressing the sheet 214 against the bonding surface of the diaphragm 23, and then peeling away the sheet 214.

Figure 4D:
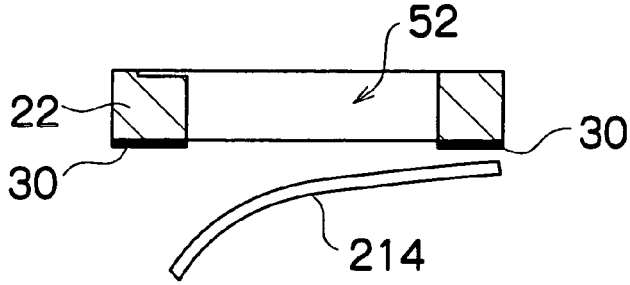

Furthermore, as shown in FIG. 4D, the NCP 30 is transferred onto the bonding surface of the pressure chamber forming plate 22 that is to be bonded with the nozzle forming plate 21. More specifically, the NCP 30 on the sheet 214 coated with the NCP is transferred onto the bonding surface of the pressure chamber forming plate 22 by pressing the sheet 214 against the bonding surface of the pressure chamber forming plate 22, and then peeling away the sheet 214.

As a method of applying the NCP 30, the mode in which the NCP is applied directly to the bonding sections from the dispenser tool 212, and the mode in which NCP 30 is previously deposited on the sheet 214 and then transferred from the sheet 214 have been described above, but it is also possible to apply the NCP 30 by screen printing using a mask. Using the NCP 30 in this way allows greater choice in the application method, and hence greater freedom in selecting a method which takes account of the circumstances of the application surface, cost benefits, and so on.

Next, the processing for curing the NCP on the bonding sections between the plates and the electrical bonding sections (the NCP curing processing) is described with reference to FIG. 5.

Figure 5:
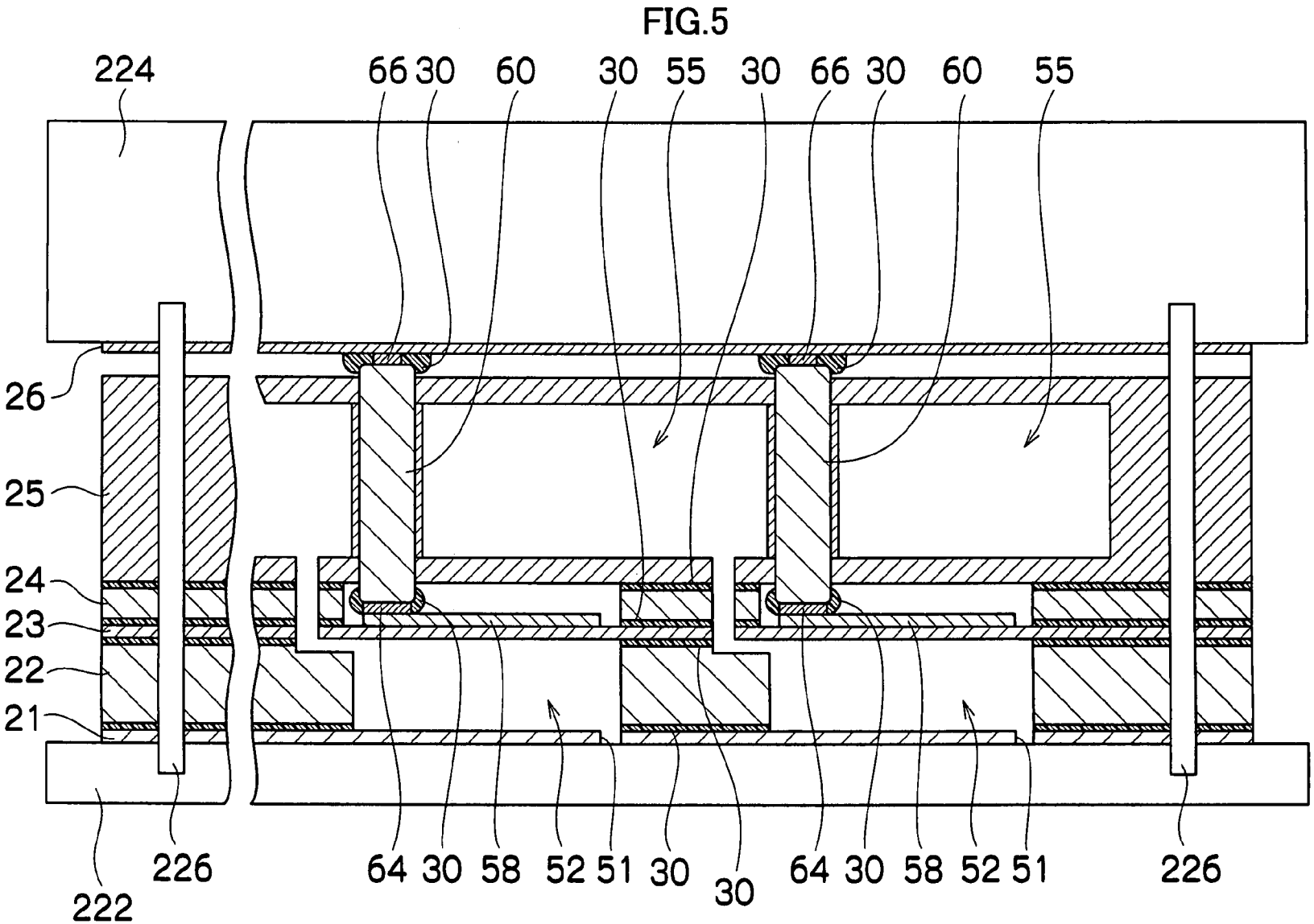
FIG. 5 is an illustrative diagram for describing a process of curing NCP, in a process for manufacturing a liquid ejection head.

As shown in FIG. 5, the plurality of plates 21, 22, 23, 24 and 25 are arranged in position and bonded together, and are then heated under prescribed curing conditions for the NCP while being pressurized.

In the embodiment shown in FIG. 5, the flexible wiring plate 26 is also arranged, in such a manner that a connection between the bump electrodes 66 on the flexible wiring plate 26 and the column-shaped electrical wires 60 is also made.

More specifically, the nozzle forming plate 21, the pressure chamber forming plate 22, the diaphragm 23 formed with the piezoelectric elements 58 (actuator forming plate), the piezoelectric element protection plate 24 (intermediate plate), the common liquid chamber forming plate 25, and the flexible wiring plate 26 are arranged in this order on a base plate 222 having a heating function, in positions registered by positioning pins 226, and a pressurization plate 224 having a heating function is laid on top of these plates. Due to the weight of the pressurization plate 224, the structure formed by arranging the nozzle forming plate 21 to the flexible wiring plate 26 (the laminated structure) is pressurized and in this pressurized state, the structure is heated to the curing temperature of the NCP 30, for a prescribed period of time, by the heating function of the base plate 222 and the pressurization plate 224.

In other words, the bonding sections between the mutually adjacent plates (the bonding section between the nozzle forming plate 21 and the pressure chamber forming plate 22, the bonding section between the pressure chamber forming plate 22 and the diaphragm 23, the bonding section between the diaphragm 23 and the piezoelectric element protection plate 24, and the bonding section between the piezoelectric element protection plate 24 and the common liquid chamber forming plate 25), and the electrical bonding sections (the bonding sections between the bump electrodes 64 of the piezoelectric elements 58 and the column-shaped electrical wires 60, and the bonding sections between the bump electrodes 66 of the flexible wiring plate 26 and the column-shaped electrical wires 60) are heated at the curing temperature of the NCP 30, while being pressurized, and hence the bonding between the mutually adjacent plates and the electrical bonding are performed simultaneously.

Desirably, the curing temperature of the NCP 30 is a relatively low temperature of 200° C. or below. Accordingly, it is possible to prevent thermal deformation due to differences in linear expansion, and the like.

The above-described embodiment is a case where the flexible wiring plate 26 is also pressurized and heated, together with the other plates, but it is also possible to bond the flexible wiring plate 26 afterwards, on its own. More specifically, after completing bonding of the plates from the nozzle forming plate 21 until the common liquid chamber forming plate 25, the NCP 30 is dispensed onto the bonding sections of the electrical wires 60 which are to be bonded with the bump electrodes 66 of the flexible wiring plate 26, and a curing process is carried out separately for these bonding sections only.

Furthermore, it is also possible to perform the bonding of the nozzle forming plate 21 separately. In other words, after bonding the plates from the pressure chamber forming plate 22 to the common liquid chamber forming plate 25, the NCP 30 is transferred onto the bonding surface between the nozzle forming plate 21 and the pressure chamber forming plate 22, and a curing process is carried out separately for this bonding section only.

The above-described embodiment is a case where the diaphragm 23 and the piezoelectric element protection plate 24 are formed as separate plates, but it is also possible to form the diaphragm 23 and the piezoelectric element protection plate 24 in an integral fashion. In this case, the plate in which the diaphragm 23 formed with the piezoelectric elements 58 and the pressure chamber protection plate 24 are formed integrally, is bonded by the NCP 30 to the bonding surface of the common liquid chamber forming plate 25.

Overall Structure of Liquid Ejection Head

Next, the overall structure of the liquid ejection head is described.

Figure 6:
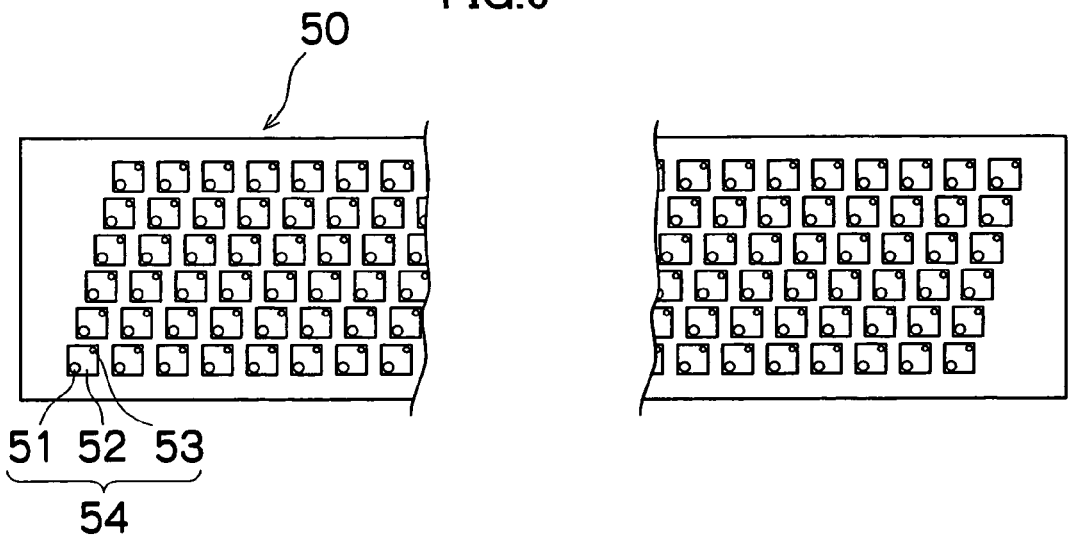
FIG. 6 is a plan view perspective diagram showing the general composition of a liquid ejection head relating to one embodiment of the present invention.

FIG. 6 is a plan view perspective diagram showing the whole of the liquid ejection head 50. In order to achieve a high resolution of the dots formed on the surface of the recording medium, it is necessary to achieve a high density of the nozzles in the liquid ejection head 50. As shown in FIG. 6, the liquid ejection head 50 according to the present embodiment has a structure in which the plurality of ink chamber units 54, each having the nozzle 51 which is the ink ejection port, the pressure chamber 52 corresponding to the nozzle 51, and the ink supply port 53, are disposed in a two-dimensional matrix arrangement, and hence the effective nozzle interval (the projected nozzle pitch) as projected to an alignment in the lengthwise direction of the liquid ejection head 50 (the direction perpendicular to the paper conveyance direction) is reduced (high nozzle density is achieved). In FIG. 6, in order to simplify the drawing, a portion of the pressure chamber units 54 is omitted from the drawing.

The detailed structure of each pressure chamber unit 54 and peripheral regions thereof shown in FIG. 6 is as described with reference to FIG. 1.

In FIG. 1, the flow channels leading from the common liquid chamber 55 to the ink supply ports 53 of the pressure chambers 52 are formed in an "L" shape, but the flow channels are depicted in this way in order to simplify the illustration in FIG. 1, and in FIG. 6, these flow channels are depicted as having an "I" shape leading perpendicularly from the common liquid chamber 55 to the ink supply ports 53 of the pressure chambers 52, in order to prioritize the ink refilling properties from the common liquid chamber 55 to the pressure chambers 52.

Figure 7:
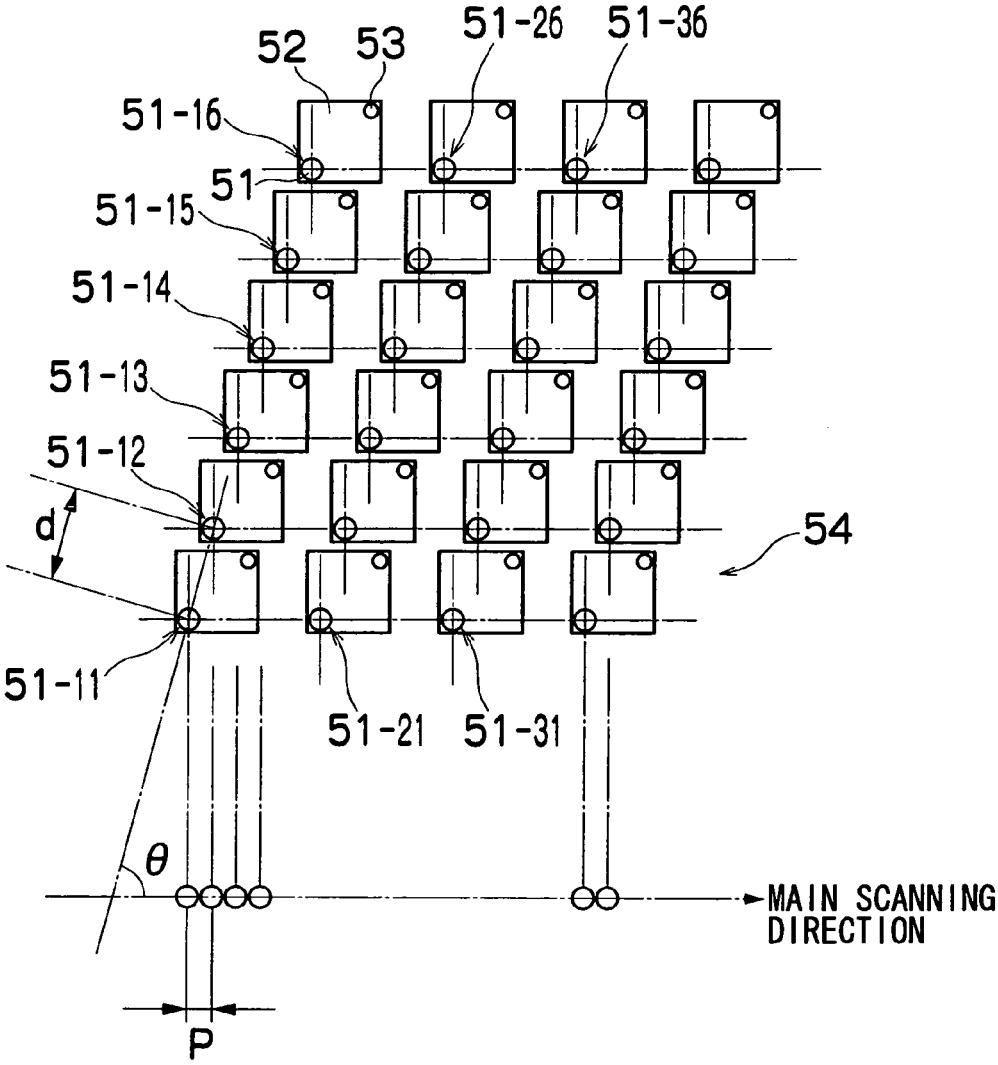
FIG. 7 is an enlarged diagram showing an enlarged view of a portion of the liquid ejection head shown in FIG. 6.

FIG. 7 is a diagram showing an enlarged view of a portion of the liquid ejection head 50 shown in FIG. 6. As shown in FIG. 7, the plurality of pressure chamber units 54 are arranged in a lattice configuration in two directions: the main scanning direction and an oblique direction forming a prescribed angle of θ with respect to the main scanning direction. More specifically, the plurality of nozzles 51 are arranged in a two-dimensional matrix configuration. By arranging the nozzles in a two-dimensional matrix of this kind, a high density is achieved for the effective nozzle density.

More specifically, by arranging the plurality of pressure chamber units 54 at a uniform pitch of d in an oblique direction forming a uniform angle of θ with respect to the main scanning direction, it is possible to treat the nozzles 51 as being equivalent to an arrangement of nozzles at a pitch P ($=d\times\cos\theta$) in a straight line in the main scanning direction. Consequently, it is possible to achieve a composition which is substantially equivalent to a high-density nozzle arrangement of 2,400 nozzles per inch in the main scanning direction.

Figure 8:
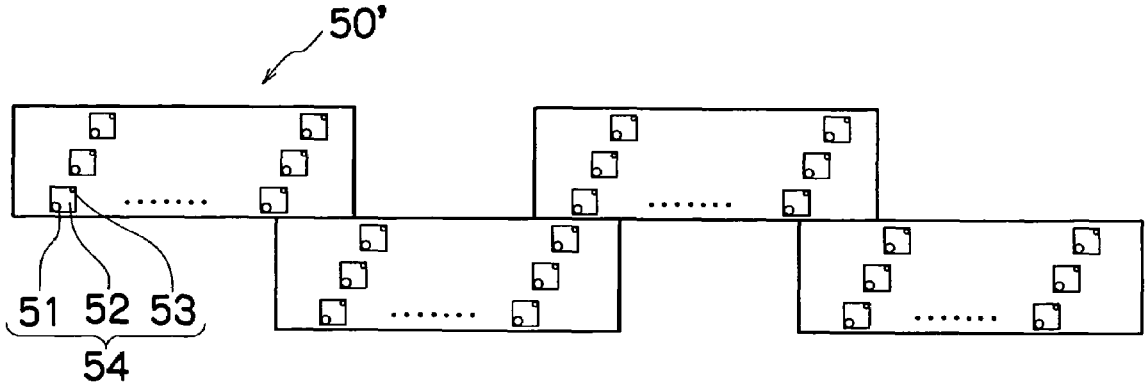
FIG. 8 is a plan view perspective diagram showing the general composition of a liquid ejection head according to a further mode.

In implementing the present invention, the nozzle arrangement structure is not limited to the embodiment shown in FIG. 6. For example, in one mode of a full line type liquid ejection head, which has a nozzle row extending through a length corresponding to the full width of the recording paper in a direction substantially perpendicular to the conveyance direction of the recording paper, instead of the composition shown in FIG. 6, it is possible to compose a line type liquid ejection head having a nozzle row of a length corresponding to the full width of the recording paper by joining together, in a staggered matrix arrangement, a plurality of short liquid ejection head blocks 50', each comprising a plurality of nozzles 51 arranged in a two-dimensional configuration, as shown in FIG. 8, for instance.

General Composition of Image Forming Apparatus

An embodiment of an image recording apparatus using the liquid ejection head 50 described above is explained.

Figure 9:
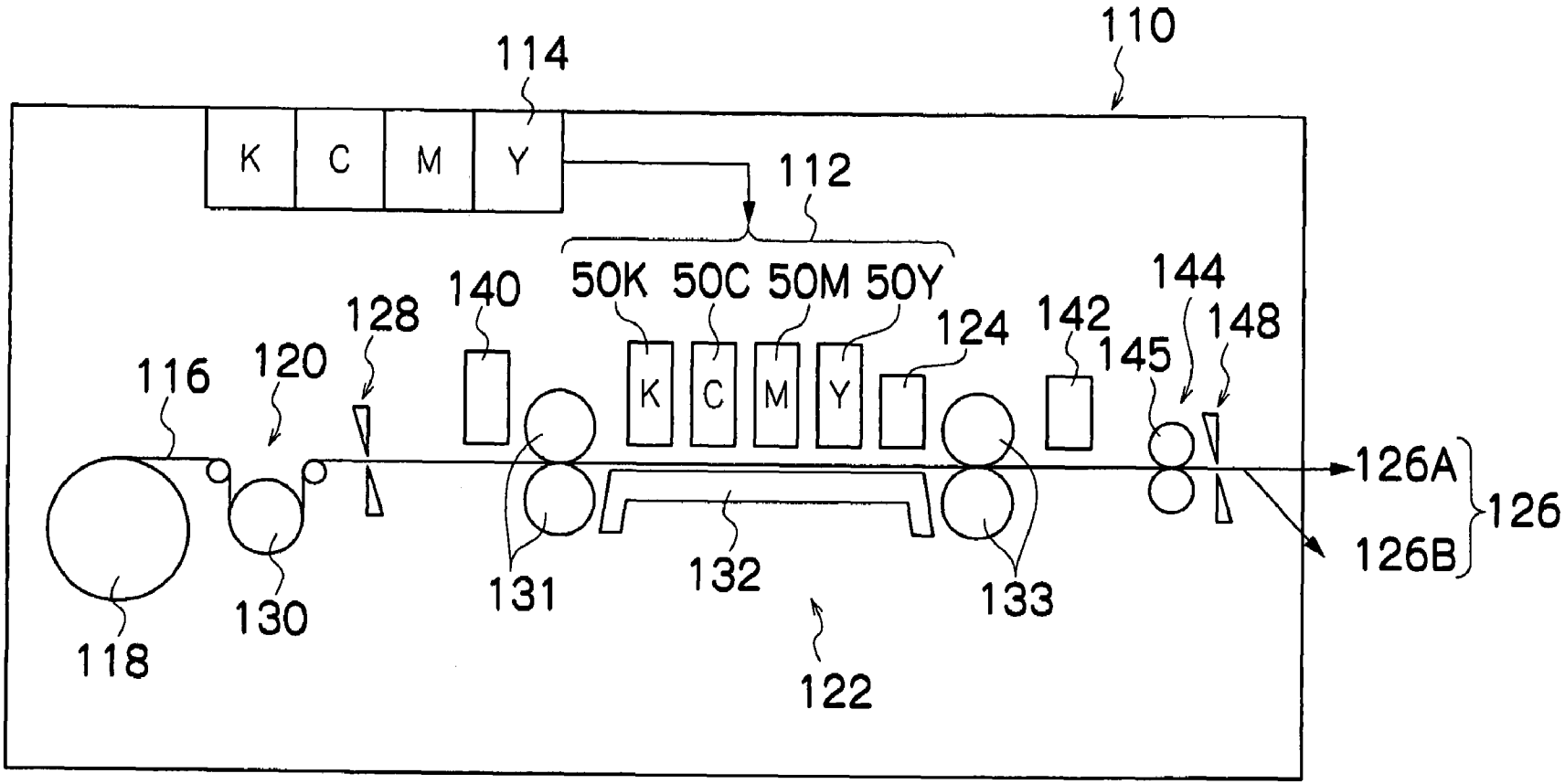
FIG. 9 is a general schematic drawing of an image forming apparatus using the liquid ejection head according to one embodiment of the present invention.

The image forming apparatus 110 shown in FIG. 9 comprises: a print unit 112 having a plurality of liquid ejection heads 50K, 50C, 50M and 50Y, each of which corresponds to the above-described liquid ejection head 50, provided respectively for ink colors of black (K), cyan (C), magenta (M), and yellow (Y); an ink storing and loading unit 114 for storing inks to be supplied to the print heads 50K, 50C, 50M and 50Y; a paper supply unit 118 for supplying recording paper 116 forming a recording medium; a decurling unit 120 for removing curl in the recording paper 116; a conveyance unit 122, disposed facing the nozzle surface (ink ejection surface) of the print unit 112, for conveying the recording paper 116 while keeping the recording paper 116 flat; a print determination unit 124 for reading the printed result produced by the print unit 112; and a paper output unit 126 for outputting recorded recording paper (printed matter) to the exterior.

The ink storing and loading unit 114 has ink tanks for storing the inks of K, C, M and Y to be supplied to the liquid ejection heads 50K, 50C, 50M, and SOY, and the tanks are connected to the liquid ejection heads 50K, 50C, 50M, and SOY by means of prescribed channels.

In FIG. 9, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 9, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto a platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode. The platen 132 in FIG. 9 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is provided in the conveyance path of the recording paper 116, on the upstream side of the print unit 112. This heating fan 140 blows heated air onto the recording paper 116 before printing, and thereby heats up the recording paper 116. Heating the recording paper 116 before printing means that the ink will dry more readily after landing on the paper.

The liquid ejection heads 50K, 50C, 50M and 50Y of the print unit 112 are full line type liquid ejection heads having a length corresponding to the maximum width of the recording paper 116 used with the image forming apparatus 110, and comprising the plurality of nozzles for ejecting ink arranged on the nozzle face through a length exceeding at least one edge of the maximum-size recording paper (namely, the full width of the printable range) (see FIG. 6).

The liquid ejection heads 50K, 50C, 50M and 50Y are arranged in color order (black (K), cyan (C), magenta (M), yellow (Y)) from the upstream side in the feed direction of the recording paper 116, and these respective liquid ejection heads 50K, 50C, 50M and 50Y are fixed extending in a direction substantially perpendicular to the conveyance direction of the recording paper 116.

A color image can be formed on the recording paper 116 by ejecting inks of different colors from the liquid ejection heads 50K, 50C, 50M and 50Y, respectively, onto the recording paper 116 while the recording paper 116 is conveyed by the conveyance unit 122.

By adopting a configuration in which the full line liquid ejection heads 50K, 50C, 50M and 50Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type liquid ejection head configuration in which a recording liquid ejection head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for discharging light-colored inks such as light cyan and light magenta are added. Furthermore, there are no particular restrictions of the sequence in which the liquid ejection heads of respective colors are arranged.

The print determination unit 124 shown in FIG. 9 has an image sensor (line sensor or area sensor) for capturing an image of the droplet ejection result of the print unit 112, and functions as a device to check for spraying defects such as blockages, landing position displacement, and the like, of the nozzles from the image of ejected droplets read in by the image sensor. A test pattern or the target image printed by the liquid ejection heads 50K, 50C, 50M and 50Y of the respective colors is read in by the print determination unit 124, and the print result is determined.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 9, the paper output unit 126A for the target prints is provided with a sorter for collecting prints according to print orders.

Figure 10:
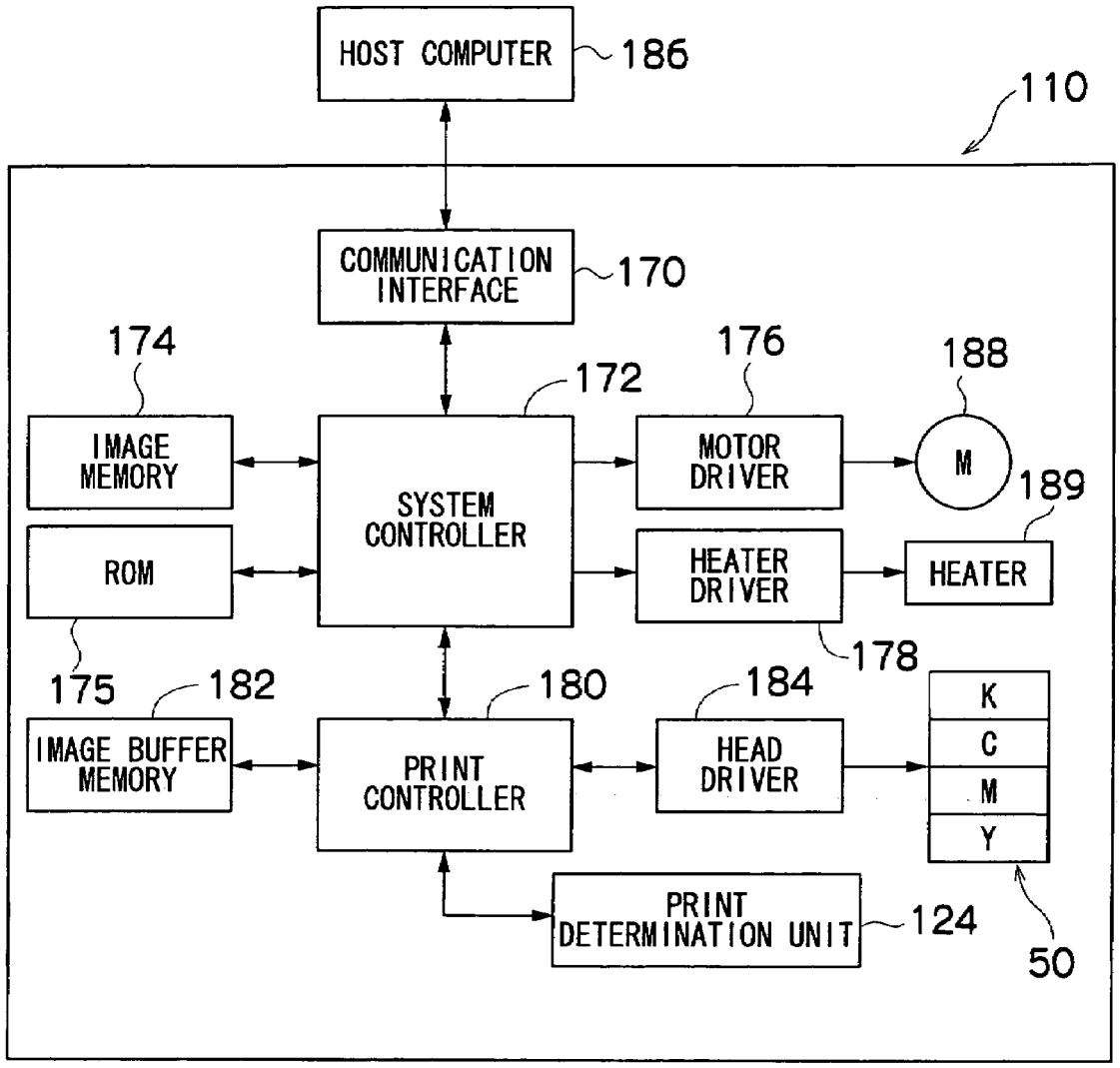
FIG. 10 is a block diagram showing the functional composition of an image forming apparatus using the liquid ejection head according to one embodiment of the present invention.

FIG. 10 is a block diagram showing an embodiment of the general functional composition of the image forming apparatus 110. As shown in FIG. 10, the image forming apparatus 110 comprises a communication interface 170, a system controller 172, an image memory 174, a ROM 175, a motor driver 176, a heater driver 178, a print controller 180, an image buffer memory 182, a head driver 184, and the like.

The communication interface 170 is an image input device for receiving image data transmitted by a host computer 186.

For the communications interface 170, a wired or wireless interface, such as a USB, IEEE 1394, wireless network, or the like, can be used.

The image data sent from the host computer 186 is received by the image forming apparatus 110 through the communication interface 170, and is temporarily stored in the image memory 174.

The system controller 172 is constituted by a central processing unit (CPU) and peripheral circuits thereof, and the like, which controls the whole of the image forming apparatus 110 in accordance with a prescribed program. More specifically, the system controller 172 controls the various sections, such as the communications interface 170, image memory 174, motor driver 176, heater driver 178, and the like, and as well as controlling communications with the host computer 186 and writing and reading to and from the image memory 174 and ROM 175, it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 9, for example. Furthermore, the heater 189 is a heating device which is used in the heating drum 130, heating fan 140 or post drying unit 142, as shown in FIG. 9.

The program executed by the CPU of the system controller 172 and the various types of data which are required for control procedures are stored in the ROM 175. The ROM 175 may be a non-rewriteable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 in accordance with commands from the system controller 172. The heater driver (drive circuit) 178 drives the heater 189 in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink spraying, from the image data in the image memory 174, and it supplies the data (dot data) thus generated to the head driver 184.

The print controller 180 is provided with the image buffer memory 182; and image data, parameters, and other data are temporarily stored in the image buffer memory 182 when image data is processed in the print controller 180. The aspect shown in FIG. 10 is one in which the image buffer memory 182 accompanies the print controller 180; however, the image memory 174 may also serve as the image buffer memory 182. Also possible is an aspect in which the print controller 180 and the system controller 172 are integrated to form a single processor.

To give a general description of the sequence of processing from image input to image formation, image data to be formed is input from an external source through a communications interface 170, and is accumulated in the image memory 174. At this stage, RGB image data is stored in the image memory 174, for example.

In this image forming apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted into dot data for each ink color by a half-toning technique, using dithering, error diffusion, or the like, in the print controller 180.

In other words, the print controller 180 performs processing for converting the inputted RGB image data into dot data for four colors, K, C, M and Y. The dot data generated by the print controller 180 is stored in the image buffer memory 182.

The head driver 184 outputs drive signals for driving the piezoelectric elements 58 corresponding to the respective nozzles 51 of the liquid ejection heads 50K, 50C, 50M and 50Y, on the basis of the dot data supplied by the print controller 180 (in other words, the dot data stored in the image buffer memory 182). A feedback control system for maintaining uniform driving conditions in the liquid ejection head may also be incorporated into the head driver 184.

By supplying the drive signals outputted by the head driver 184 to the liquid ejection heads 50K, 50C, 50M and 50Y, ink is ejected from the corresponding nozzles 51. By controlling ink ejection from the liquid ejection heads 50K, 50C, 50M and 50Y in synchronization with the conveyance speed of the recording paper 116, an image is formed on the recording paper 116.

Besides this, the present invention is not limited to the embodiments described in the embodiments, and various design modifications and improvements may be implemented without departing from the scope of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a flow channel plate in which liquid flow channels and electrical wires are formed;

an actuator forming plate on which actuators for generating pressure when ejecting the liquid are formed;

plate bonding parts including a first non-conductive paste through which the flow channel plate and the actuator forming plate are bonded together;

first bump electrodes formed on the actuator forming plate;

electrical bonding parts which bond the electrical wires and the first bump electrodes on the actuator forming plate together, the electrical bonding parts including a second non-conductive paste having same curing conditions with the first non-conductive paste;

a flexible printed circuit which is connected to the electrical wires; and second bump electrodes formed on the flexible printed circuit;

wherein the electrical wires are column-shaped electrical wires which pass through the liquid flow channels and connect the first bump electrodes on the actuator forming plate with the second bump electrodes on the flexible printed circuit.

2. The liquid ejection head as defined in claim 1, wherein the first and second non-conductive pastes include inorganic filler particles of a size not more than 5 μm.

3. An image forming apparatus, comprising the liquid ejection head as defined in claim 1, which forms an image on a recording medium by means of the liquid ejected from the liquid ejection head onto the recording medium.

4. The liquid ejection head as defined in claim 1, wherein the shape of the column-shaped electrical wires can be selected from a group consisting of circular cylinder shape, right prism shape, and tapered shape.

5. The liquid ejection head as defined in claim 1, wherein the first and second bump electrodes are column-shaped bump electrodes having a flat surface on the part that is bonded to the column-shaped electrical wires.

6. A liquid ejection head, comprising:

a pressure chamber forming plate in which pressure chambers connected to liquid ejection ports are formed;

an actuator forming plate on which actuators for generating pressure when ejecting the liquid are formed;

a common liquid chamber forming plate which is arranged on a side of the actuator forming plate reverse to a side thereof adjacent to the pressure chamber forming plate, a common liquid chamber and electrical wires being formed in the common liquid chamber forming plate, the common liquid chamber supplying the liquid to the pressure chambers, the electrical wires rising up substantially perpendicularly with respect to a surface on which the actuators are arranged;

plate bonding parts including a first non-conductive paste through which the actuator forming plates and the common liquid chamber forming plate are bonded together;

first bump electrodes formed on the actuator forming plate;

electrical bonding parts which bond the electrical wires and the first bump electrodes on the actuator forming plate together, the electrical bonding parts including a second non-conductive paste having same curing conditions with the first non-conductive paste;

a flexible printed circuit which is connected to the electrical wires; and second bump electrodes formed on the flexible printed circuit;

wherein the electrical wires are column-shaped electrical wires which pass through the common liquid chamber and connect the first bump electrodes on the actuator forming plate with the second bump electrodes on the flexible printed circuit.

7. The liquid ejection head as defined in claim 6, further comprising:

second electrical bonding parts through which the flexible printed circuit and the electrical wires are electrically bonded together, the second electrical bonding parts including a third non-conductive paste bonding the second electrical bonding parts and having the same curing conditions with the first non-conductive paste.

8. The liquid ejection head as defined in claim 6, wherein the first and second non-conductive pastes include inorganic filler particles of a size not more than 5 μm.

9. An image forming apparatus, comprising the liquid ejection head as defined in claim 6, which forms an image on a recording medium by means of the liquid ejected from the liquid ejection head onto the recording medium.

10. The liquid ejection head as defined in claim 6, wherein the shape of the column-shaped electrical wires can be selected from a group consisting of circular cylinder shape, right prism shape, and tapered shape.

11. The liquid ejection head as defined in claim 6, wherein the first and second bump electrodes are column-shaped bump electrodes having a flat surface on the part that is bonded to the column-shaped electrical wires.

* * * * *